US010077626B2

(12) United States Patent
Xu et al.

(10) Patent No.: US 10,077,626 B2
(45) Date of Patent: Sep. 18, 2018

(54) FRACTURING PLUG AND METHOD OF FRACTURING A FORMATION

(71) Applicants: YingQing Xu, Tomball, TX (US); Xiaobin Huang, Tomball, TX (US)

(72) Inventors: YingQing Xu, Tomball, TX (US); Xiaobin Huang, Tomball, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 151 days.

(21) Appl. No.: 15/148,433

(22) Filed: May 6, 2016

(65) Prior Publication Data

US 2017/0321506 A1 Nov. 9, 2017

(51) Int. Cl.

| | |
|---|---|
| ***E21B 33/134*** | (2006.01) |
| ***E21B 43/116*** | (2006.01) |
| ***E21B 43/26*** | (2006.01) |

(52) U.S. Cl.

CPC ..... *E21B 33/134* (2013.01); *E21B 43/116* (2013.01); *E21B 43/26* (2013.01)

(58) Field of Classification Search

CPC ..... E21B 23/00; E21B 47/14; E21B 47/12; E21B 43/261; E21B 33/134; E21B 33/12; E21B 43/116; E21B 23/065

See application file for complete search history.

(56) References Cited

U.S. PATENT DOCUMENTS

| | | | | |
|---|---|---|---|---|
| 2,701,614 | A * | 2/1955 | Ragan | E21B 23/065 166/120 |
| 5,704,426 | A * | 1/1998 | Rytlewski | E21B 23/00 166/297 |
| 2009/0272529 | A1* | 11/2009 | Crawford | E21B 43/1185 166/250.15 |
| 2013/0168083 | A1* | 7/2013 | McCarter | E21B 23/00 166/250.01 |
| 2014/0251612 | A1* | 9/2014 | Powers | E21B 33/1208 166/281 |
| 2016/0040492 | A1* | 2/2016 | Vinson | E21B 23/06 166/386 |
| 2017/0115102 | A1* | 4/2017 | Knight | E21B 43/117 |
| 2017/0175472 | A1* | 6/2017 | Carisella | E21B 27/02 |
| 2017/0234108 | A1* | 8/2017 | Xu | E21B 34/12 166/373 |

OTHER PUBLICATIONS

Blevins, et al.; "A Unique Plug for a Restricted Wellbore"; SPE 146559; SPE North American Unconventional Gas Conf/ Exhibition, the Woodlands, TX, USA; Jun. 14-16, 2011; 7 pages.

Fractal Multistage stimulation perforating system; Schlumberger; 2014; www.slb.com/fractal; 1 page.

Fas Drill (R) Ultra Frac Plug; Halliburton 2017; www.halliburton.com; 1 page.

* cited by examiner

*Primary Examiner* — Michael R Wills, III

(74) *Attorney, Agent, or Firm* — Cantor Colburn LLP

(57) ABSTRACT

A fracturing system including a plug having a solid mandrel preventing fluid flow therepast when set. A setting tool in operable communication with the plug; and a perforating gun disposed adjacent to the setting tool. A method for fracturing a formation.

17 Claims, 1 Drawing Sheet

FRACTURING PLUG AND METHOD OF FRACTURING A FORMATION

BACKGROUND

So-called "plug and perf" systems are fracturing systems known to the art of hydrocarbon exploration and recovery. The systems generally run a seat to depth, set the seat, release the seat and actuate a perforating gun run with the seat to perforate a casing of the borehole. It is known that the seat must be open to flow so that the perf guns may be redressed and run back to the target area in the event they do not fire as intended. Flow of fluid is required to move system components in the borehole as will be appreciated by those of skill in the art.

In order to fracture a surrounding formation after the perforation operation, a plug is dropped onto the seat, creating an impediment to fluid flow sufficient to allow pressure to be built uphole of the plug for fracturing the formation through holes in the casing created by the perf guns.

While the system works well, the art is always in search of developments that improve efficiency and reduce cost.

SUMMARY

A fracturing system including a plug having a solid mandrel preventing fluid flow therepast when set; a setting tool in operable communication with the plug; and a perforating gun disposed adjacent to the setting tool.

A method for fracturing a formation includes running a plug, setting tool, and perforating gun to a target location in a borehole; actuating the perforating gun causing firing of perforating charges; and actuating the setting tool in response to the perforating charges firing; and setting the plug with the setting tool.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
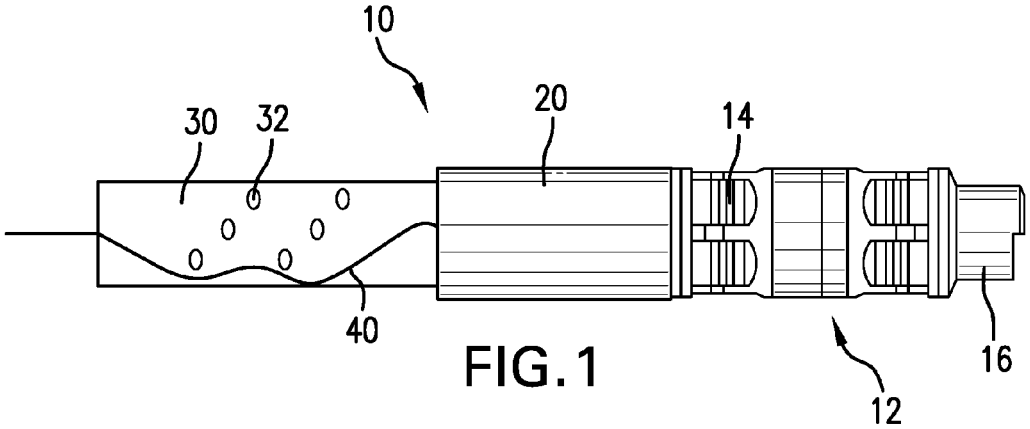
FIG. 1 is a schematic view of a first embodiment of a plug and perf type tool as disclosed herein.

Referring to FIG. 1, is a schematic view of a first embodiment of a plug and perf type tool 10 having a plug 12 that is from outward appearance similar to seats of the prior art. One of ordinary skill in the art will recognize the slips 14 and mandrel 16 outer appearance. The plug 12 however has no seat as it has no flow bore therethrough. Rather the plug is a solid mandrel that when set prevents fluid flow therepast. As such, the plug 12 requires no ball be dropped later to prevent fluid passage. The plug 12 is inherently a flow blocking component. Attached thereto is a setting tool 20 and to that a perforating gun 30 with charges 32. Noticeable in the vicinity of the perforating gun 30 is a conductor 40 that is routed intentionally around the charges 32 such that actuation of the charges 32 will not damage the conductor 40. In the FIG. 1 embodiment, the conductor must remain functional at a time subsequent to the perforating gun 30 being actuated so that the setting tool 20 may be actuated.

One of the significant departures of the invention from the art is that the plug 12 is set only after the perforating gun 30 is actuated. In the art, the seat that is otherwise analogous to the plug 12 hereof is set before actuation of the perforating gun. Because the plug 12 is set after the gun 30 is actuated, there is no need to provide a flow through bore in the plug 12 and hence no need to seat a ball later in the process as would be familiar to those of skill in the art. It is important, however, for each embodiment of tool 10, that the setting tool 20 be actuable after the gun 30 is actuated. This is when the plug 12 is set and hence a signal for setting the plug 12 must be available to the setting tool 20 at that time. The three figures identified above in the brief description of drawings illustrate three embodiments that ensure that such a signal is available to the setting tool 20 after actuation of the perforating gun 30.

With respect to FIG. 1, the conductor 40, which may be electrical, hydraulic, optic, etc., is routed as noted above to be protected from the charges 32 of the perforating gun 30. The routing may be as illustrated simply around the charges 32 or may be configured in a helical pattern that matches the charges helical pattern. The conductor may also be protected within a conduit of some kind having properties that can resist damage from the action of the charges 32. Providing the conductor 40 remains in communicative connection with the setting tool 20 so that the setting tool 20 may be actuated at a selected time, the positioning and protection of conductor 40 is acceptable.

Figure 2:
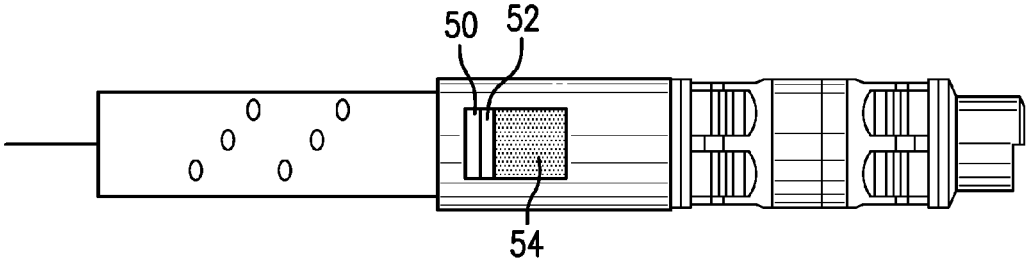
FIG. 2 is a schematic view of a second embodiment of a plug and perf type tool as disclosed herein.
Figure 3:
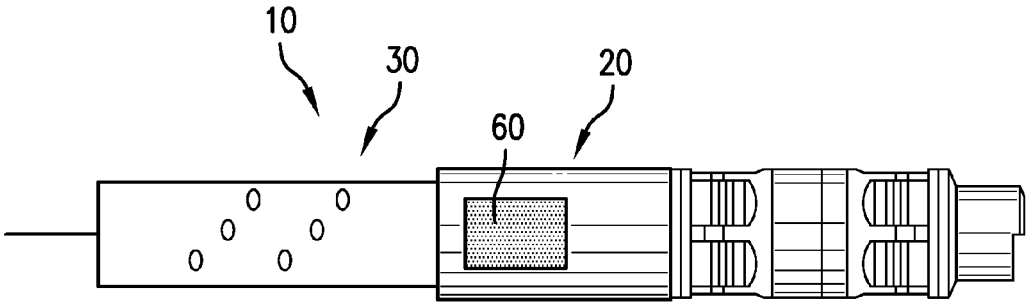
FIG. 3 is a schematic view of a third embodiment of a plug and perf type tool as disclosed herein.

With respect to FIGS. 2 and 3, the tool 10 is configured with a sensor 50 that is configured to detect the actuation of gun 30. Detection may be through acoustic noise or through vibration or through acceleration or through an actual impact between two components of the tool 10. In one iteration, illustrated in FIG. 2, the setting tool comprises a sensor 50, an energy source 52 and a prime mover to set the plug 12 such as power charge 54. The sensor may be of any type that can reliably recognize a successful actuation of the perforating gun 30. The sensor then signals the power charge or other setting configuration to actuate using the source to energize that operation. Because the setting tool 20 in this configuration is self-triggering, there is no need to have communication with surface or any other remote command center. That is not to say however that such a communication cannot still be employed as in the embodiment of FIG. 2, so that redundancy and or monitoring is also possible. Such a combination is contemplated herein for the embodiments of FIGS. 2 and 3 and for other potential embodiments combining any features of FIGS. 1-3 with any other feature of FIGS. 1-3. The source 52 may be a battery or other energy source such as a chemical source.

Similar to the FIG. 2 embodiment FIG. 3 is directed to an impact triggered inflator similar to automobile airbags. An inflator 60 is schematically illustrated as a part of the setting tool 20 and is to be any commercially available airbag actuator currently commercially available. The expansion of gas caused by the inflator 60 is used as an actuation force for the setting of the slips 14 of plug 12. Alternatively, two or more chemicals that together react to evolve an expanding gas may be contained in the setting tool 20. For purposes of illustration, the separate chemicals may be considered contained in the battery and power charge containers shown in FIG. 2. The chemicals may be configured as liquids solids or a combination. It is to be understood that the containment of the chemicals may be in separate containers or combined containers with separate chambers. One or more of the containers may be frangible or otherwise openable responsive to the perforating gun actuating. Once open the chemicals may come into contact with each other and will have been selected to produce a reaction that evolves an expanding gas. Nonlimiting examples include using water and a material reactive with water such as Lithium, Sodium, Potassium, etc.

Employing the tool 10 discussed above a significant time advantage can be realized over current plug and perf tools. Because the plug 12 of the invention does not have a flow bore, there is no need to drop a ball later in the process. Waiting for a ball to drop and or be pumped several thousand feet is expensive due to time consumption. This was always necessary in prior art systems because the seat was set before the perforating guns were actuated. Accordingly, in the event a perforating gun did not fire, the seat required flow in order to retrieve the gun to surface for redress and then send it back to the target location. Because the plug 12 of the invention does not have a flow bore, no plug is needed. But because no bore exists, the plug must not be set prior to the actuation of the perforating guns. Accordingly the invention does not set the plug 12 until after the guns are actuated and the charges fire. The setting tool uses the various sensing capabilities with which it is imbued to register the firing of the charges and then will take action to set the plug. This can be automatic as in embodiments 2 and 3 or can be monitored or driven from surface through the conductor of embodiment 1. The method of fracturing a formation includes running the plug 12, the setting tool 20, and the perforating gun 30 to a target location in a borehole. Then rather than setting the plug as the prior art would do with a seat, the guns are actuated and the perforating charges fired. Only in response to the firing of the charges whether by control from surface or automatically from the downhole setting tool sensing or impact capabilities discussed above does the setting tool actuate and set the plug. Because of the timing of setting of the plug, the tool 10 may be moved in the borehole and even removed from the borehole for perforating gun redress in the event the perforating charges fail to fire.

Set forth below are some embodiments of the foregoing disclosure:

Embodiment 1

A fracturing system including a plug having a solid mandrel preventing fluid flow therepast when set; a setting tool in operable communication with the plug; a perforating gun disposed adjacent to the setting tool.

Embodiment 2

The fracturing system of any of the preceding embodiments further comprising a conductor passing along the perforating gun and protected from charges of the perforating gun.

Embodiment 3

The fracturing system of any of the preceding embodiments wherein the conductor is protected by routing of the conductor around the charges.

Embodiment 4

The fracturing system of any of the preceding embodiments wherein the setting tool includes an energy source and a sensor, the sensor configured to detect the occurrence of an actuation of a perforating gun charge.

Embodiment 5

The fracturing system of any of the preceding embodiments wherein the energy source is a battery.

Embodiment 6

The fracturing system of any of the preceding embodiments wherein the sensor is one or more of an accelerometer, an impact sensor, a vibration sensor, and an acoustic sensor.

Embodiment 7

The fracturing system of any of the preceding embodiments wherein the setting tool includes an impact triggered inflator.

Embodiment 8

The fracturing system of any of the preceding embodiments wherein the setting tool includes two or more chemicals in one or more containers.

Embodiment 9

The fracturing system of any of the preceding embodiments wherein the one or more containers are openable in response to the perforating gun actuating.

Embodiment 10

The fracturing system of any of the preceding embodiments wherein the two or more chemicals are reactive with each other to produce an expanding gas.

Embodiment 11

A method for fracturing a formation comprising: running a plug, setting tool, and perforating gun to a target location in a borehole; actuating the perforating gun causing firing of perforating charges; actuating the setting tool in response to the perforating charges firing; and setting the plug with the setting tool.

Embodiment 12

The method of any of the preceding embodiments further comprising blocking fluid flow with the plug.

Embodiment 13

The method of any of the preceding embodiments wherein the actuating the setting tool includes sensing the firing of perforating charges.

Embodiment 14

The method of any of the preceding embodiments wherein the sensing includes one or more of sensing vibrations associated with the charges firing, sensing acoustic noise associated with charges firing, sensing impact associated with the charges firing, and sensing acceleration associated with the charges firing.

Embodiment 15

The method of any of the preceding embodiments further including moving the plug, setting tool and perforating gun uphole and downhole including out of the borehole for redress of the perforating gun due to failure of the perforating charges to fire borehole until perforating charges fire and setting of the plug occurs.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

The invention claimed is:

1. A fracturing system comprising: a plug having a solid mandrel preventing fluid flow therepast when set; a setting tool in operable communication with the plug; a perforating gun disposed adjacent to the setting tool; a sensor, the sensor configured to detect the occurrence of an actuation of a perforating gun charge of the perforating gun; and the setting tool being responsive to the sensor.

2. The fracturing system as claimed in claim 1 further comprising a conductor passing along the perforating gun and protected from charges of the perforating gun.

3. The fracturing system as claimed in claim 2 wherein the conductor is protected by routing of the conductor around the charges.

4. The fracturing system as claimed in claim 1 wherein the setting tool includes an energy source.

5. The fracturing system as claimed in claim 4 wherein the energy source is a battery.

6. The fracturing system as claimed in claim 1 wherein the sensor is one or more of an accelerometer, an impact sensor, a vibration sensor, and an acoustic sensor.

7. The fracturing system as claimed in claim 1 wherein the setting tool includes an impact triggered inflator.

8. The fracturing system as claimed in claim 1 wherein the setting tool includes two or more chemicals in one or more containers.

9. The fracturing system as claimed in claim 8 wherein the one or more containers are openable in response to the perforating gun actuating.

10. The fracturing system as claimed in claim 8 wherein the two or more chemicals are reactive with each other to produce an expanding gas.

11. A method for fracturing a formation comprising:

running a plug, setting tool, and perforating gun to a target location in a borehole;

actuating the perforating gun causing firing of perforating charges;

actuating the setting tool in response to the perforating charges firing; and setting the plug with the setting tool and;

fracturing the formation through perforations created during the firing of perforating charges.

12. The method as claimed in claim 11 further comprising blocking fluid flow with the plug.

13. The method as claimed in claim 11 wherein the actuating the setting tool includes sensing the firing of perforating charges.

14. The method as claimed in claim 13 wherein the sensing includes one or more of sensing vibrations associated with the charges firing, sensing acoustic noise associated with charges firing, sensing impact associated with the charges firing, and sensing acceleration associated with the charges firing.

15. The method as claimed in claim 11 further including moving the plug, setting tool and perforating gun uphole and downhole including out of the borehole for redress of the perforating gun due to failure of the perforating charges to fire borehole until perforating charges fire and setting of the plug occurs.

16. A method for fracturing a formation comprising:

running a plug, setting tool, and perforating gun to a target location in a borehole;

actuating the perforating gun causing firing of perforating charges;

actuating the setting tool in response to the perforating charges firing; and setting the plug with the setting tool wherein the actuating the setting tool includes sensing the firing of perforating charges.

17. The method as claimed in claim 16 wherein the sensing includes one or more of sensing vibrations associated with the charges firing, sensing acoustic noise associated with charges firing, sensing impact associated with the charges firing, and sensing acceleration associated with the charges firing.

* * * * *